US007537099B2

(12) United States Patent
Howells

(10) Patent No.: US 7,537,099 B2
(45) Date of Patent: May 26, 2009

(54) COIN DISCRIMINATOR WHERE FREQUENCIES OF EDDY CURRENTS ARE MEASURED

(75) Inventor: Geoffrey Howells, Salisbury (GB)

(73) Assignee: Scan Coin Industries AB, Malmo (SE)

( * ) Notice: Subject to any disclaimer, the term of this patent is extended or adjusted under 35 U.S.C. 154(b) by 113 days.

(21) Appl. No.: 10/494,599

(22) PCT Filed: Nov. 5, 2002

(86) PCT No.: PCT/SE02/02027

§ 371 (c)(1),
(2), (4) Date: Sep. 7, 2004

(87) PCT Pub. No.: WO03/041021

PCT Pub. Date: May 15, 2003

(65) Prior Publication Data

US 2005/0051409 A1 Mar. 10, 2005

(30) Foreign Application Priority Data

Nov. 5, 2001 (SE) ..... 0103690

(51) Int. Cl.
*G07D 5/08* (2006.01)

(52) U.S. Cl. ..... 194/320

(58) Field of Classification Search ..... 194/320, 194/302, 303, 317; 73/163; 324/233–234
See application file for complete search history.

(56) References Cited

U.S. PATENT DOCUMENTS 3,599,771 A 8/1971 Hinterstocker
3,788,440 A 1/1974 Propice et al.
4,184,366 A 1/1980 Butler
4,360,034 A 11/1982 Davila et al.

(Continued)

FOREIGN PATENT DOCUMENTS

EP 0 119 000 9/1984

(Continued)

OTHER PUBLICATIONS

Scan Coin Technical Manual CDS MK 1 Coin Deposit System, 1991, Table of Contents and pp. 13-23.

*Primary Examiner*—Patrick Mackey
*Assistant Examiner*—Mark Beauchaine
(74) *Attorney, Agent, or Firm*—Womble Carlyle Sandridge & Rice, PLLC

(57) ABSTRACT

A coin processing machine with a coin discriminator operated by a method is provided. The coin discriminator measures how a coin having an iron core covered by a layer of copper, brass, or bronze affects a coil when the coin is subjected to magnetic fields generated by the coil, external to the coin. Eddy currents induced in the coin are detected external of the coin. The discriminator induces a magnetic field in the coil by driving the coil with time varying drive signals having high frequencies. The coin discriminator receives the coin at precise positions in the magnetic field and detects the eddy currents induced in the coin by measuring the eddy currents through the coil. Then, the coin discriminator compares the measured eddy currents with predetermined values for different types of coils, and determines the structure, materials and type of the coin.

24 Claims, 4 Drawing Sheets

U.S. PATENT DOCUMENTS

| | | | | | |
|---|---|---|---|---|---|
| 4,361,218 | A | | 11/1982 | Van Dort | |
| 4,460,080 | A | * | 7/1984 | Howard | 194/317 |
| 4,471,864 | A | | 9/1984 | Marshall | |
| 4,717,006 | A | * | 1/1988 | Chapman et al. | 194/318 |
| 4,754,862 | A | * | 7/1988 | Rawicz-Szczerbo et al. | 194/319 |
| 4,951,800 | A | * | 8/1990 | Yoshihara | 194/317 |
| 4,971,187 | A | * | 11/1990 | Furuya et al. | 194/318 |
| 5,067,604 | A | | 11/1991 | Metcalf | |
| 5,240,099 | A | | 8/1993 | Brown et al. | |
| 5,316,120 | A | | 5/1994 | Ibarrola | |
| 5,458,225 | A | | 10/1995 | Iwamoto et al. | |
| 5,662,205 | A | * | 9/1997 | Levasseur | 194/317 |
| 5,687,829 | A | | 11/1997 | Churchman | |
| 5,915,518 | A | | 6/1999 | Hopwood et al. | |
| 5,988,348 | A | * | 11/1999 | Martin et al. | 194/317 |
| 6,039,643 | A | | 3/2000 | Kurosawa et al. | |
| 6,047,808 | A | * | 4/2000 | Neubarth et al. | 194/317 |
| 6,056,104 | A | | 5/2000 | Neubarth et al. | |
| 6,196,371 | B1 | | 3/2001 | Martin et al. | |
| 6,227,343 | B1 | * | 5/2001 | Neathway et al. | 194/319 |
| 6,298,709 | B1 | * | 10/2001 | Artzner et al. | 73/1.38 |
| 6,325,197 | B1 | | 12/2001 | Furuya | |
| 6,340,082 | B1 | * | 1/2002 | House et al. | 194/317 |
| 6,398,001 | B1 | * | 6/2002 | Hutchinson et al. | 194/317 |
| 6,520,308 | B1 | | 2/2003 | Martin et al. | |

FOREIGN PATENT DOCUMENTS

| | | | |
|---|---|---|---|
| EP | 0 343 871 | A2 | 11/1989 |
| EP | 0 349 114 | A2 | 1/1990 |
| EP | 0 724 237 | A2 | 7/1996 |
| EP | 0 841 641 | A2 | 5/1998 |
| EP | 1 020 818 | A1 | 7/2000 |
| EP | 1 104 920 | A1 | 6/2001 |
| GB | 2 135 095 | A | 8/1984 |
| GB | 2 243 238 | A | 10/1991 |
| GB | 2 301 925 | A | 12/1996 |
| GB | 2 323 199 | A | 9/1998 |
| GB | 2 323 200 | A | 9/1998 |
| GB | 2 357 883 | A | 7/2001 |
| GB | 2358272 | | 7/2001 |
| WO | WO 87/07742 | | 12/1987 |
| WO | WO 97/07485 | | 2/1997 |
| WO | WO 97/25692 | | 7/1997 |
| WO | WO 00/25274 | | 5/2000 |
| WO | WO 01/29785 | A1 | 4/2001 |

* cited by examiner

COIN DISCRIMINATOR WHERE FREQUENCIES OF EDDY CURRENTS ARE MEASURED

RELATED APPLICATION

The present application is a § 371 national phase application of PCT application serial no. PCT/SE02/02027, filed on Nov. 5, 2002, and which claims priority under 35 U.S.C. §119 to Swedish application serial no. 0103690-4, filed on Nov. 5, 2001. Swedish application serial no. 0 103690-4 and PCT application serial no. PCT/SE02/02027 are hereby incorporated by reference in their entireties as if fully set forth herein.

TECHNICAL FIELD

The present invention relates to a method of identifying a metal coin. The method is used in a coin discriminator measuring how a metal coin, which has an metal core covered by a layer of another metal, affects coil means when the coin reaches magnetic fields generated by the coil means external to the coin. Furthermore, the eddy currents induced in the metal coin are detected by detection means external of the coin.

The present invention also relates to a coin processing machine including a coin discriminator as above type.

DESCRIPTION OF THE PRIOR ART

Coin discriminators are used for measuring different physical characteristics of a coin in order to determine its type, e.g. its denomination, currency or authenticity. Various dimensional, electric and magnetic characteristics are measured for this purpose, such as the diameter and thickness of the coin, its electric conductivity, its magnetic permeability, and its surface and/or edge pattern, e.g. its edge knurling. Coin discriminators are commonly used in coin handling machines, such as coin counting machines, coin sorting machines, vending machines, gaming machines, etc. Examples of previously known coin handling machines are for instance disclosed in WO97/07485 and WO87/07742.

Moreover, methods and devices that measure the resistance or conductivity of a coin by exposing it to a magnetic pulse and detecting the decay of eddy currents induced in the coin are generally known in the technical field.

The way in which such coin discriminators operate is described in e.g. GB-A-2 135 095, in which a coin testing arrangement comprises a transmitter coil, which is pulsed with a rectangular voltage pulse so as to generate a magnetic pulse, which is induced in a passing coin. The eddy currents thus generated in the coin give rise to a magnetic field, which is monitored or detected by a receiver coil. The receiver coil may be a separate coil or may alternatively be constituted by the transmitter coil having two operating modes. By monitoring the decay of the eddy currents induced in the coin, a value representative of the coin conductivity may be obtained, since the rate of decay is a function thereof.

Coin discriminators in prior art often employ a small coil with a diameter smaller than the diameter of the coin. The coil induces and detects eddy currents in an arbitrary point of the coin, i.e. the actual part of the coin, which is subject to the conductivity measurement above, the eddy currents will vary depending on the orientation, speed, angle, etc., of the coin relative to the coil. This approach is sufficient for a normal homogeneous coin made of a single metal or metal alloy.

However, in recent years new non-homogeneous coins have been issued in different countries. For example, these coins may contain both bimetallic coins and iron coins covered in copper.

These new coins are very similar to some existing coins, i.e. they have almost the same physical size and are made from the same or similar materials.

An iron core or disc forming an iron coin may be plated or clad with one or more layers of copper or brass around either its whole surface or only at both sides leaving its rim freely exposed as an iron rim.

All of the above-mentioned features make it difficult to discriminate between coins, especially between two iron coins having the same diameter of which one iron coin has a freely exposed iron rim and the other iron coin has an iron rim that is only partly or completely plated with only a thin layer of copper, brass, or bronze.

One problem occurs when introducing new coins in different countries. This introduction means that coin accepting and counting machines must distinguish between the new coins and the existing national currencies. In most cases, this is not a problem. However, different coins with essentially the same dimensions may have the same "appearence" when measured due to different manufacturing methods of the coins. For example, a type A of a coin is very similar to another coin, a type B coin. The type B and the type A coin are both iron coins. The differences between these iron coins are the following. The type B iron coins are clad in brass in comparison to the type A iron coins, which are either plated or clad with copper. Another difference is that the type B iron coins have the iron exposed on the rim and the type A iron coins have a thin layer of copper over the rim. In theory, there is an average diameter difference of between these two types of A and B iron coins. However, a small sample of the type A iron coins, which diameters were measured with digital callipers, had diameters outside the their specified tolerances. The type B iron coins that have been in use a long time tend to become smaller, especially the diameter. We expect to find type B and type A iron coins with the same size.

Similarly, a type C and a type D coins are also difficult to discriminate. Both coins are iron coins covered with copper. The type C iron coin has a copper covered rim. The type D iron coin may have a thin smear of copper on one side of the rim. This is due to the manufacturing method of this type D iron coin. This copper smear is created when the die cutter punches out the coin, whereby a thin layer of copper may be smeared over a part of the edge, i.e. the rim, of the iron coin in the punching direction.

The coin discriminators of the prior art described above fail to provide a sufficiently accurate determination of the type of the above-mentioned iron coins due to a similar effect on resistance for the coils measuring the iron coins conductivity when the measured iron coins passes the coils.

The coin measurement results obtained vary largely depending on the actual spot of measurement on the coin. If a given coin is measured at a position located in the vicinity of the rim of a coin, which has a thin copper layer around an iron core, a coin with an iron core having an exposed, non-covered, iron rim may be mistakenly "seen" or discriminated as being a coin with an iron core surrounded by a relatively thin copper or brass layer at all sides, i.e. over both the faces and the rim of the iron coin. Furthermore, the prior art solutions have problems in identifying if the layers covering the rims of the iron coins are made of copper, brass or bronze.

Moreover, iron coins with only a thin smear of copper, brass or bronze partly covering the rim may be difficult to discriminate because they can be "seen" as iron coins with both a non-covered rim or a covered rim.

SUMMARY OF THE INVENTION

The main objects of the present invention are to allow repeatable and accurate determination of coin types, i.e. coins comprising for example an iron core covered completely or partly by a thin layer made of another metal such as copper, brass or bronze and having almost the same physical size, and, in some cases, exactly the same size, by detecting resistance and inductance changes in the coil that measures the coin for determining if the coin has a covered or non-covered rim, and for determining the surface conductivity for the coin.

These objects are achieved by providing a coin processing machine with a coin discriminator operated by a method according to the invention. The method measures how a coin, which has for example an iron core covered by a layer of another metal such as copper, brass, or bronze, affects coil means when the coin is subjected to magnetic fields generated by the coil means external to the coin. Eddy currents induced in the coin are detected by detection means external of the coin. The coin discriminator induces a magnetic field in the coil means by driving the coil means with time varying drive signals having high frequencies. The coin discriminator receives the iron coin at precise positions in the magnetic field. Then, the coin discriminator detects the eddy currents induced by the magnetic field in the iron coin by measuring the eddy currents through the coil means, and compares the measured eddy currents through the coil means with predetermined values for different types of iron coins. Finally, the coin discriminator determines the structure, materials and type of the measured iron coin using the predetermined values.

By providing a coin processing machine with a coin discriminator operated by a method according to the invention, the following advantages are obtained. The same coil means is used to make two measurements of the iron coin at different points of time, thereby eliminating the need and cost for an additional coil means and the additional electronics that would have to be operatively connected to the extra coil means. Other advantages are that the construction and maintenance of the coin processing machine are simplified and the associated costs for these measurements are reduced.

BRIEF DESCRIPTION OF THE DRAWINGS

The invention will now be described in more detail, reference being made to the accompanying drawings, in which.

DETAILED DESCRIPTION OF THE INVENTION

Figure 1:
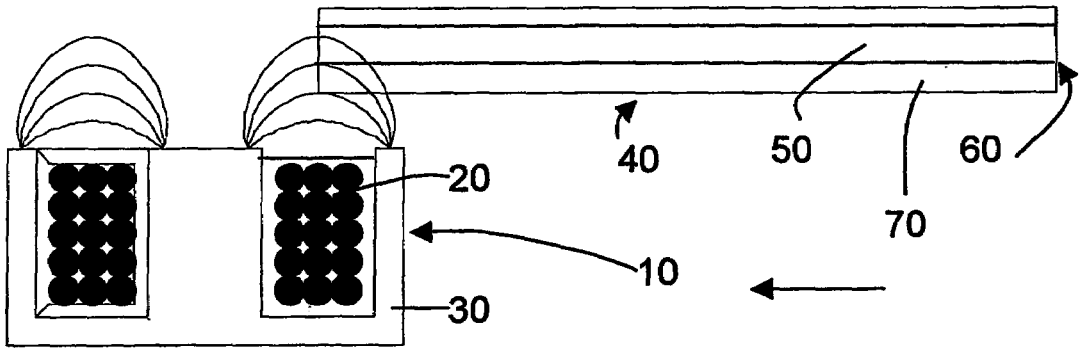
FIG. 1 is a schematic sectional view of an iron coin and a coin discriminator according to the invention.

FIG. 1 shows a coin discriminator 10 comprising a coil 20 mounted in a housing 30. The coil 20 is connected to an electrical device (not shown) for supplying current pulses thereto. Voltage pulses may be used instead of current pulses, this is a common knowledge for a skilled person. A coin 40 is shown just as it reaches the generated magnetic field or pulses of the coin discriminator. Furthermore, the coin discriminator comprises detection means (not shown) for detecting changes in resistance and inductance of the coil 20 caused by the iron coin affecting the magnetic pulses generated by the coil means in response to the current pulses supplied from the electrical device.

In this embodiment, the coin is an iron coin 40 comprising a large electrical conductive core 50 of a first metal or alloy, e.g. iron or steel, in the form of a disc. The coin core 50 is shown with dotted lines inside the coin 40 to the right in FIG. 2. The iron core 50 is a little smaller than in reality so that the difference in size between the outer periphery of the iron core and the outer contour of the coin 40 is shown more clearly, i.e. exaggerated. This area between the outer periphery of the iron core 50 and the outer contour of the coin 40 is a thin layer of copper, brass, or bronze or any other metal used as the outer surface on coins, as is readily envisaged by a skilled person.

The coin discriminator 10 according to the invention makes two measurements, each measurement is done at different parts of each coin, i.e. at the coin core 50 and a coin rim 60, respectively. This will be explained more in detail below. The detection means (not shown) of the coin discriminator 10 determines the surface conductivity of the coin 40 in one measurement by inducing eddy currents by means of the coil 20 in the surface of the coin core 50. The other measurement determines whether the coin has a freely exposed iron core 50 at the rim 60 or if the iron core, i.e. the rim, is covered with a thin layer 70 of another metal, e.g. copper, brass or bronze. A bond between the disc shaped core and the layer is labeled 80. This bond 80 does not exist if the iron core is not covered at the rim 60, as is understood by a skilled person.

Figure 2:
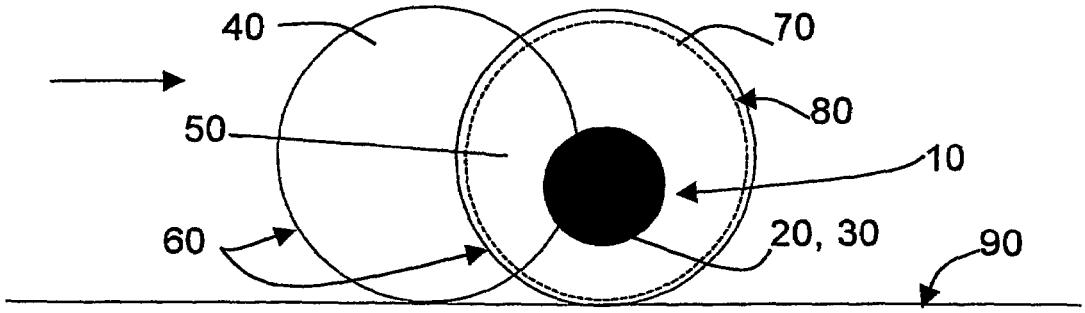
FIG. 2 is a schematic plan view of the relative positions between an iron coin in two different positions and the coin discriminator during discrimination.

The coil 20 in FIGS. 1 and 2 acts as a transmitter coil for exposing the iron coin 40 to a magnetic field. The exposure of the iron coin is done when it moves past the coin discriminator 10 along a coin rail 90 (shown in FIG. 2). The direction of movement for the iron coin is illustrated by a horizontal arrow pointing to the left in FIG. 1. Alternatively, the iron coin may move in the other direction, i.e. to the right, in FIG. 1, as is envisaged by a skilled person.

Furthermore, the coil 20 of the coin discriminator 10 shown in FIGS. 1 and 2 also acts as a receiver coil being operatively connected to suitable electronics, this will be explained in more detail later on in this description, for detecting both the magnetic field variations, and more particularly the inductance and resistance variations in the coil 20 when a measured iron coin 40 passes it, and the surface conductivity of the measured iron coin and converting them into corresponding signals. The signals are supplied to a detector (not shown), which is arranged to measure the decay and change of the signals and in response determine a respective value of the inductance and resistance changes in the coil 20 and the surface conductivity of the coin 40. The determined surface conductivity values for each measured iron coin 40 and the effect of the iron coin on the inductance and resistance in the coil 20 are subsequently used for identifying the type of the iron coin.

FIG. 2 shows the relative positions between one of the essential parts of the coin discriminator 10, i.e. the coil 20 in its housing 30, and the iron coin 40 during the discrimination. In this embodiment, the coil is mounted about 3 mm above the coin rail 90, i.e. the lower end of the coil is 3 mm above the rail. This position for the coil 20 depends on which type of iron coins that are going to be measured and the dimension of the iron coins. Smaller or larger iron coins 40 may require other coil positions in order to get accurate readings.

Each iron coin 40 moves past the coin discriminator 10 on the coin rail 90 during the measurements. The discrimination according to the invention is done at different points of time because the same coil 20 is used for two measurements. One measurement determines if the iron core, i.e. the rim 60 of the iron coin 40 is exposed or covered by a thin layer of copper, brass, or bronze. The other measurement determines if the iron coin core 50 is covered by a copper, brass, or bronze layer 70. The copper, brass, or bronze layer on the iron coin core is detected by measuring the conductivity of the surface for the iron coin 40. The bare or covered iron coin/core rim 60 is determined by its magnetic properties, i.e its effect on the resistance and inductance for the coil 20 when the iron coin rim reaches or passes the coil. Depending on the magnetic properties of the rim 60, the resistance and inductance of the coil 20 will be influenced to different extents.

When the iron coin 40 moves from left to right in FIG. 2, the coin rim 60 first reaches the coil 20, therefore the rim measurement is done first in this embodiment. The direction of movement for the iron coin is illustrated by a horizontal arrow placed to the left in FIG. 2 and pointing to the right. The iron coin could of course move in the other direction if desired. When the coin rim 60 is measured the iron coin should leave about 75% of the coil 20 exposed, i.e. the coin rim covers about 25% of the coil. Then, shortly afterwards, the centre of the iron coin, more specifically, the iron coin core 50, reaches/covers the coil and the second measurement takes place. The rim measurement could of course be done after the surface conductivity measurement is done. This is because the coin rim 60 passes the coil 20 once more before the iron coin 40 is finally transported past the coil, as is readily understood by a skilled person.

In FIG. 2, the iron coin 40 should preferably be placed over the centre of the coil 20 when the surface conductivity measurement takes place, as in the position to the right for the iron coin. When the coin rim 60 is measured the position for the iron coin should be as shown in FIG. 1 with the magnetic field striking the rim of the iron coin. Additionally, the position for the coil 20 must be decided in relation to the dimensions of the coins that are going to be measured. The position for the coil is chosen so that the rim 60 of the iron coin 40 does not affect this second measuring of the surface conductivity. The distance between the coin rim 60 and the coil 20 should be larger than approximately 1 mm for securing an accurate reading of the surface conductivity.

The coil 20 of the coin discriminator 10 is small compared to the diameter of the iron coins 40 to be measured. The coil may have a diameter between 5 to 10 mm. Preferably, the ferrite core should have a diameter between 5 to 10 mm, but, preferably, a diameter of 7.3 mm. The ferrite may be between 2 to 6 mm, preferably, 3.7 mm high or thick and be filled with a wire having a diameter between 0.08 to 1 mm, preferably, 0.2-mm. The wire should, preferably, be made of copper. In principle, any small coil could be used in the coin detector or discriminator 10, as is envisaged by a skilled person. The use of a ferrite pot core to direct the magnetic field makes the detector/discriminator more efficient.

In a typical coin counting machine (not shown), the position of the iron coin 40 is known from other sensors (not shown), as is envisaged by a skilled person. This information is used to make the two measurements of the coin at different times using the same coil 20.

The surface conductivity is measured when the coil 20 is covered by the iron core 50 of the iron coin 40, as shown in FIG. 2. This means that the iron coin has its center essentially aligned with the center of the coil 20 or the coin core 50 at least covers the whole coil. The duration of the current pulses supplied by the electrical device to the coil may be chosen in accordance with the actual application.

Figure 3:
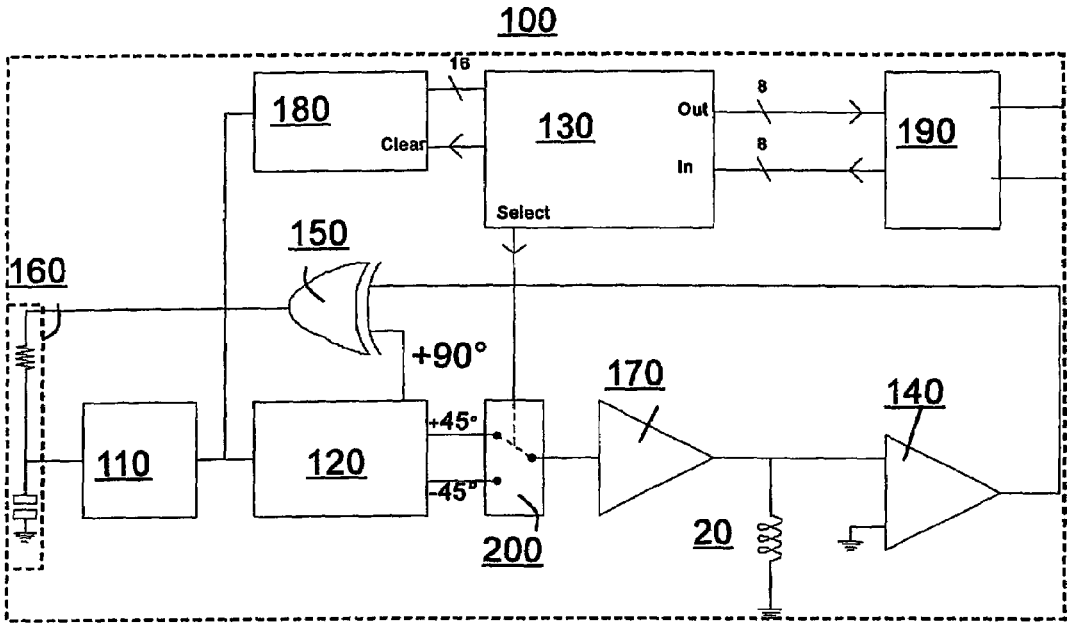
FIG. 3 is a block diagram of the electronic circuit used in the coin discriminator in FIGS. 1 and 2.

To make the coil 20 work as a part of the coin detector/discriminator 10 an electronic circuit 100 shown in FIG. 3 put a time varying current through the coil. Changes in the current produce changes in the magnetic field produced by the coil 20, whereby the changing magnetic field produces an electric current in the iron coin 40. This current in the iron coin is called an eddy current. The changing eddy current in turn produces a changing magnetic field, which is measured by the coil 20.

If the same coil 20 is used for both generating and sensing the eddy currents, the effect of the iron coin 40 is to cause an apparent change in the inductance and resistance of the coil. The electronic circuit 100 measures these changes and uses them to identify the type of the iron coin.

The electronic circuits used to measure iron coins 40 with a single coil 20 can be divided into two types:

1. Continuous wave (CW) techniques that drive the coil 20 with a continuous sine or square wave.

2. Pulse induction (PI) techniques that use a step change in current to produce an exponentially decaying eddy current within the iron coin 40.

The electronic circuit 100 in FIG. 3 drives the coin discriminator 10 by using the continuous wave (CW) technique, which drives the coil 20 with a continuous sine or square wave. The CW electronics can be divided into two types:

1. Frequency shift

2. Phase shift

The first method, the frequency shift is the simplest and cheapest. With this technique, the coil 20 forms part of the frequency determining elements of an oscillator 110. A change in the inductance of the coil causes a change in the oscillator frequency. This frequency shift is used to identify the iron coin 40. The limitation of this simple method is that it does not measure the change in the resistance of the coil 20, and, thus, it only uses half of the available information.

The second method, the phase shift method drives the coil 20, usually at a fixed frequency, and then measures the amplitude and phase of the coil voltage or current. By measuring both amplitude and phase, the change in inductance and resistance for the coil can be calculated.

To separate a copper covered iron coin 40 from a brass or bronze covered iron coin according to the invention, the coin discriminator 10 according to the invention uses high frequency eddy currents. The skin depth effect will make these currents flow mainly in the copper, brass or bronze layer. The skin depth effect when using AC-power instead of DC-power is a physical effect that is common knowledge for a skilled person.

In this embodiment, a type A, a type B, and a type D iron coin are used to explain the function of the coin discriminator 10 according to the invention. These coins are quite similar and good examples of reference iron coins 40. Alternatively, any other type of existing or future iron coin with a large iron core 50, which is completely or partly covered by a thin layer of copper, brass or bronze may of course be used, as is envisaged by skilled person.

The type A and the type B coin are made of iron clad in brass. A type E and the type D coins are iron coins clad in copper. A type F, the type C and the type A coins are iron coins either plated or clad in copper. The type E and D coins often have a copper smear on the rim 60, i.e. the copper smear only partly covers the rim. The brass plating has a specified thickness of 0.068 mm. The skin depth in 25% IACS brass will be this distance at 3.7 MHz. This means that we must use a frequency over 3.7 MHz to "hide" the iron core 50, i.e. a lower frequency would make the eddy current penetrate further into the coin, thereby "revealing" or reaching the iron core.

The 25% IACS brass is defined according to the International Annealed Copper Standard (IACS) scale. This scale relates to the conductivity of metals. On this scale, the conductivity of pure annealed copper is taken as 100%, the bronze used in "copper" coins is about 50%, and brass is typically 25%. The gold alloy in some coins is about 16% and the copper-nickel alloy used in "silver" coins is just over 5%. This is readily understood by a skilled person.

The maximum frequency used in the coin discriminator 10 is also determined by the skin depth effect, which, in this embodiment, is the skin depth in the copper wire of the coil 20. Because the current only flows on the surface of the wire, the resistance is greater than its resistance when DC power is used. From this point of view, a frequency as low as possible is preferred.

Based on these Skin depth arguments, the preferred frequencies is in the range of 4 to 10 MHz but, preferably, between 5 to 8 MHz when used in the coin discriminator 10 according to the invention.

It is possible to design electronics to accurately measure the change in inductance and resistance of a coil 20 at these frequencies using the phase shift method. However, the electronic circuit 100 in FIG. 3 will not be simple or cheap because of the high frequencies used. The unique feature of the electronic circuit 100 in the coin discriminator 10 according to the invention is the use of a frequency shift method that can accurately measure changes in both inductance and resistance fast and reliable.

In FIG. 3, an electronic circuit 100 for operating the coin discriminator 10 is shown as a block diagram. A voltage controlled oscillator 110 runs at a frequency of eight times the self-resonance frequency for the coil 20. A divide by 8 circuit 120 generates frequencies at the coil resonance with phases of plus and minus 45°. A controller 130 selects one of these two phases via a selector device 200 and drives the coil 20 via a bi-directional current source 170. The voltage across the coil 20 will be a sine wave. The output from a comparitor 140 is a logic level square wave with the same zero crossings as the sine wave in the coil 20. This square wave is compared with a reference phase of 90° from the divide by 8 circuit 120. The comparison is done via an exclusive OR gate 150 followed by a low pass filter 160 to the left in FIG. 3. The low pass filter comprises two main components of which none is explained in more detail, such a low pass filter is a common knowledge for a skilled person. The output voltage from the low pass filter 160 is used to control the frequency of the oscillator 110. The constant current source 170 is used for driving the coil 20. A 16-bit counter 180 measures the frequency of the voltage-controlled oscillator 110. A detector interface 190 is used for connecting the controller 130, i.e. the electronics driving the coin discriminator 10, to other electronics (not shown). The other electronics could be any kind of suitable hardware and software, e.g. a PC, used for further processing of the measurement results, e.g. presentation of the result for an operator of the coin counting and sorting machine, or a processor in a coin counting and sorting machine.

If the current source 170 were driven by a zero degrees phase, the electronic circuit 100 would lock to the resonant frequency of the coil 20. The electronic circuit would then be recognised as an example of a known type, which is called a phased locked loop and common knowledge for a skilled person.

By driving the current source 170 with a phase of 45°, the electronic circuit 100 will still lock. However, the frequency will produce a phase shift of 45° between the voltage and current through the coil 20. From the physics it is known that this 45° phase shift only occurs at the "3 dB points" on the resonance curve. By using phases of both plus and minus 45° the frequencies of the upper and lower "3 dB points" can be measured. The average of these two frequencies is the resonance frequency for the coil 20. The difference between the frequencies is the width of the resonance frequency.

The 16 bit counter 180 measures the frequency of the voltage-controlled oscillator 110. The controller 130 does this by counting how many cycles occur in a fixed period. In this embodiment, a period may be in the range of 50 to 200 μs but a period of 125 μs is preferred, so that the count gives the frequency change in kHz. The controller also interfaces to the rest of the electronics, i.e. the detector interface 190 connected to other components (not shown) of a coin counting and sorting machine 700 shown as a block diagram in FIG. 7.

Figure 4:
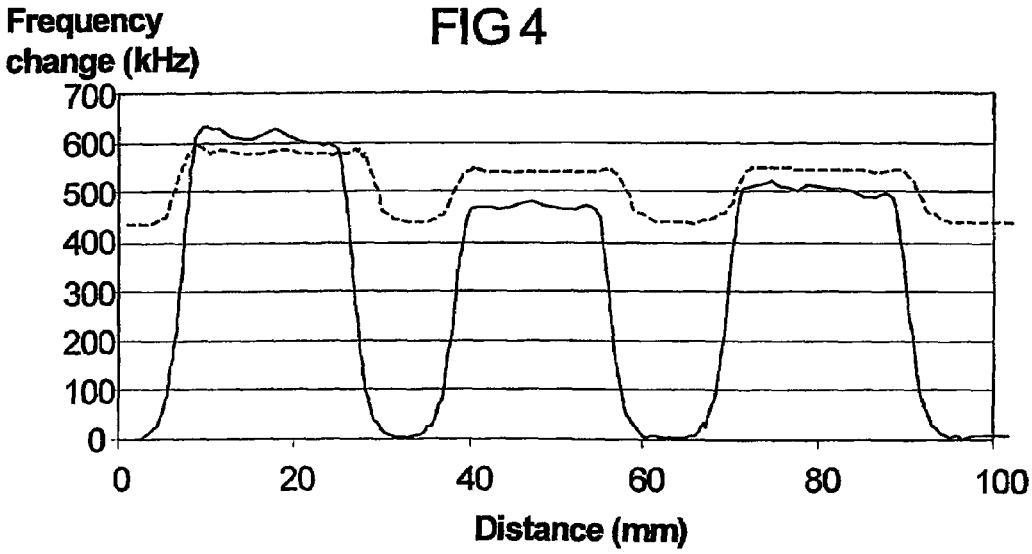
FIG. 4 is a diagram over readings of frequency changes when three different iron coins pass the coin discriminator.

In FIG. 4, readings from the preferred coin discriminator 10 according to the invention are shown. The y-axis on the graph shows the frequency changes in kHz caused by the three iron coins 40 passing the coil 20. From left to right there are the type B, the type D and the type A coin.

In FIG. 4, the x-axis is simply distance in mm along the coin rail 90. The solid line is the change in the centre or resonance frequency of the oscillator 110. The coil 20 used in FIG. 4 is the coil shown in all of the earlier drawings. With this coil, the no-coin centre or resonance frequency is between 4 to 10 MHz, preferably, 5 MHz. The first iron coin 40, the brass plated type B, increases this frequency by 600 kHz. This frequency change is range dependent. The above graph was made with a coil to coin range of 0.9 mm.

The effect from the iron coin 40 on the resistance of the coil 20 depends on the range or distance between the iron coin and the coil. The effect from the iron coin on the resistance for the coil decreases as the distance between the iron coin and the coil increases. The decrease of the coil resistance occurs in proportion to the diameter of the circularly flowing eddy current in the coin. The effect from the coin 40 on the inductance of the coil 20 also depends on the range or distance between the iron coin and the coil. The effect on the inductance for the coil decreases as the distance between the iron coin and the coil increases. The decrease of the coil inductance occurs in proportion to the diameter raised to a second power of the circularly flowing eddy current in the coin, i.e. in proportion to the area covered by the circularly flowing eddy current.

The dotted line is the width of the resonance frequency, this is the frequency difference between the upper and lower "3 dB points". The width of the resonance frequency is a direct measurement of resistance in the coil 20. The wider the resonance frequency, then the higher the resistance. The dotted line demonstrates this effect. The type B iron coin 40 has a resonance frequency width of 570 kHz compared to 530 kHz for the other two iron coins. This is because brass has a higher resistance than copper, i.e. copper is a better conductor than brass. The dotted line shows that without a coin 40, the resonance frequency width is 430 kHz. This is due to the resistance of the wire in the coil 20.

The text book method for finding the resistance of a coil 20 is from its 'Q' or quality factor. A high value of Q implies a low coil resistance. The Q and the self-resonant frequency of a coil are given by the equations:

The self-resonant frequency is $$f_0 = \frac{1}{2\pi\sqrt{LC}}$$

The Q of a coil 20 is $$Q = \frac{2\pi fL}{R} = \frac{f}{\Delta f}$$

Where:

L is the inductance of the coil 20

C is the total capacitance in parallel with the coil

R is the resistance of the coil at the resonance frequency $f_0$ is the self resonant frequency Δf is the frequency difference between the 3 dB points.

Figure 5:
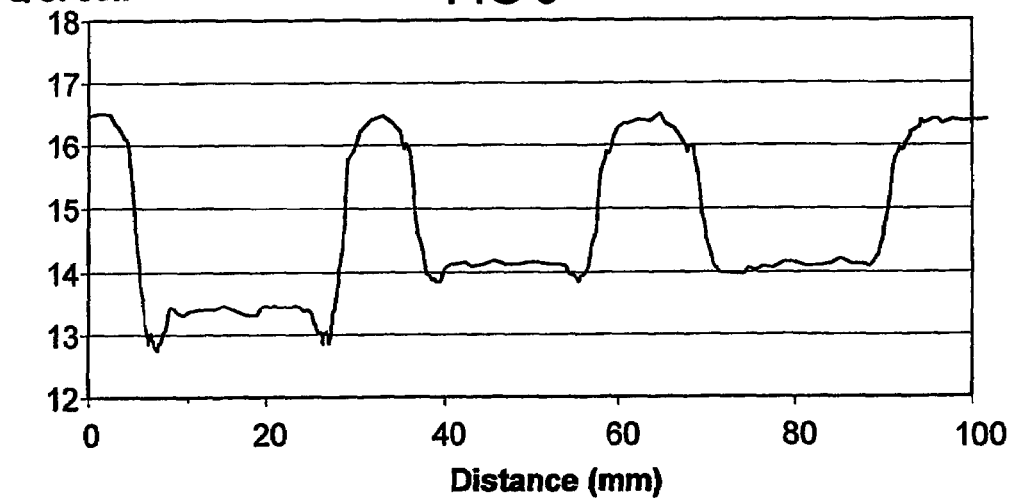
FIG. 5 is a diagram over readings of resistances in the coin discriminator when the three iron coins in FIG. 4 pass it.

The readings from the three iron coins 40 in FIG. 4 have been used to produce the graph in FIG. 5.

In FIG. 5, the curve shows the Q of the coil 20 dropping each time the measured iron coin 40 passes over it. The graph shows the greater drop for the high resistance brass plated type B iron coin to the left compared to the two copper plated iron coins, i.e. the type D in the middle and the type A to the right.

Figure 6:
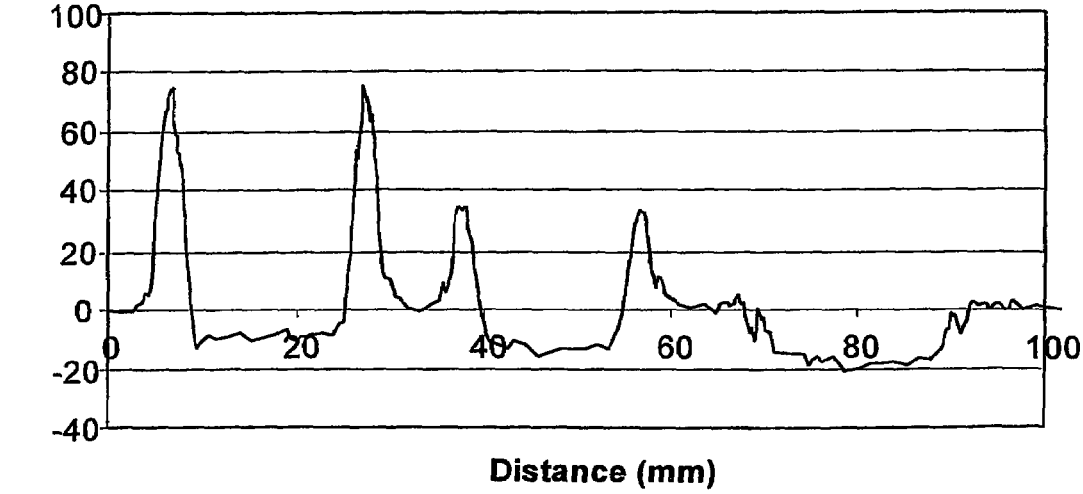
FIG. 6 is a diagram over the three iron coins in FIGS. 4 and 5 with their iron rim readings highlighted.

The graph in FIG. 6 shows the same iron coin readings as in FIGS. 4 and 5 but, here, the readings are processed to highlight the readings of the iron rims on each iron coin 40. As before the type B followed by the type D followed by the type A coin pass the coin discriminator 10 and two measurements for each iron coin are done.

FIG. 6 simply illustrates the resonance frequency width minus one quarter of the centre frequency shift. The processing must be simple because of the high speed of the iron coins 40 passing through the coin discriminator 10 and the coin counting and/or sorting machine 700 shown in FIG. 7.

The iron rims on the brass plated type B iron coin 40 are shown more clearly than on the copper plated type D iron coin. This is because of two effects pulling in opposite directions. The magnetic properties of the iron are trying to increase the inductance of the coil 20, whereas the eddy currents in the surface of the iron coin are trying to reduce the coil inductance. The low resistance copper plated type D iron coin allows a greater eddy current and thus hides more of the iron at the rim 60 of the iron coin 40.

The copper covered rims 60 of the type A iron coin 40 hide the iron completely at these high frequencies. This means that the inductance of the coil 20 only decreases as this type A iron coin passes over it.

Figure 7:
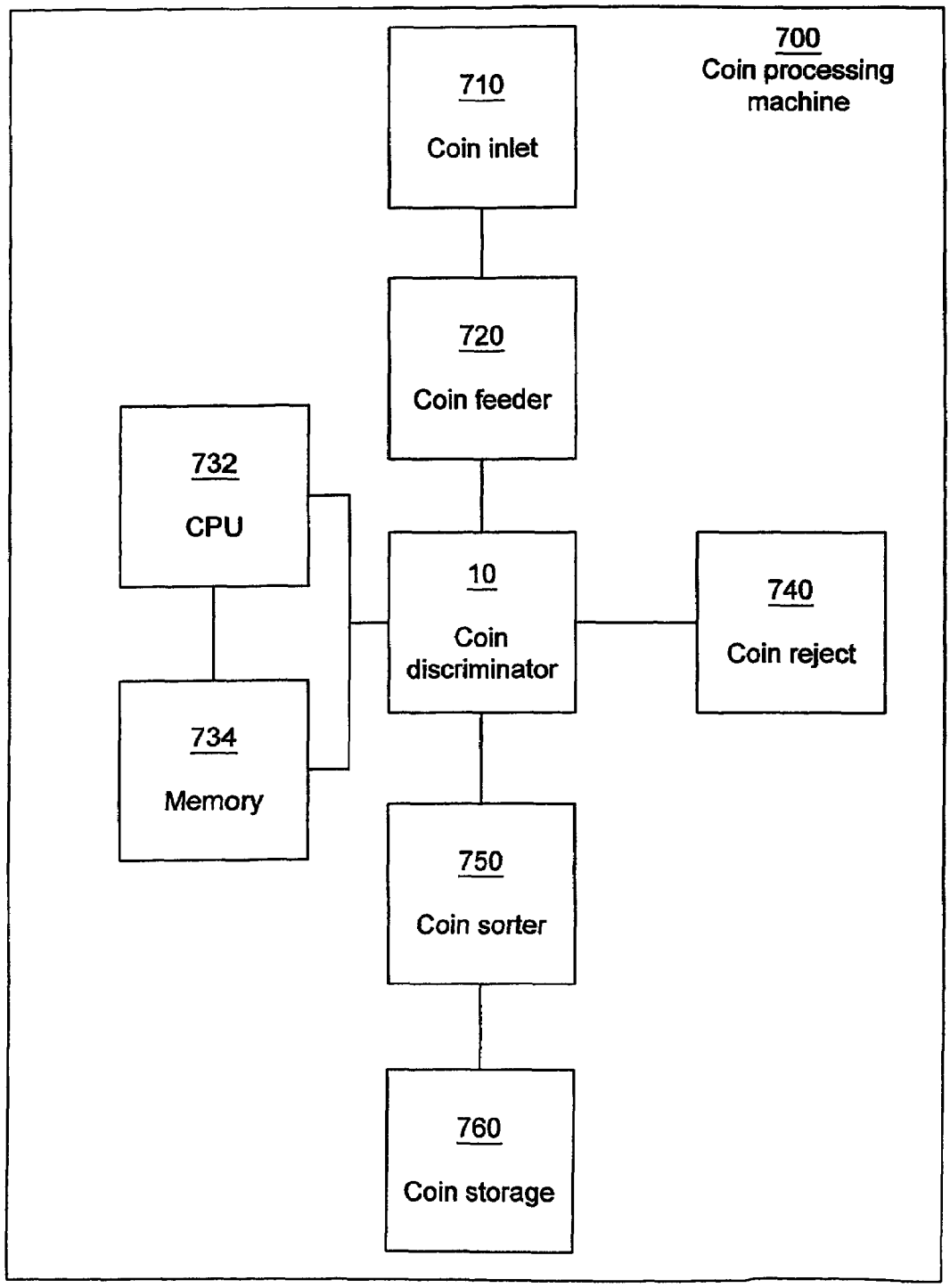
FIG. 7 is a block diagram of a coin processing machine comprising the coin discriminator in FIGS. 1 and 2.

Referring now to FIG. 7, the coin processing machine 700 according to one aspect of the present invention is schematically illustrated. In an exemplifying but not limiting sense, the coin processing machine 700 of FIG. 7 is selected to be a coin sorter. The mass/es of coins 40, which are to be sorted by the machine 700, are deposited into a coin inlet 710. Here, the coins may be any types of coins not just iron coins covered by a thin layer of copper, brass or bronze, as is readily understood by a skilled person. The coins are fed by a coin feeder 720, such as a hopper and/or an endless belt, to the coin discriminator 10, which has been described above with reference to FIGS. 1, 2, and 3. The coin discriminator 10 is operatively connected to a logic device 732 in the form of a CPU, which is operatively connected to a memory 734, such as a RAM, ROM, EEPROM or flash memory. The memory 734 stores a set of coin reference data, which is used by the logic device 732 to discriminate among the coins 40 received through the coin inlet 710. More specifically, the coin reference data relates to typical values of conductivity and permeability for all different types of coins and to typical values of the effect from all different types of coins on the resistance and inductance of the coil 20, that the coin processing machine 700 is capable of processing.

The logic device 732 is programmed to receive measurement data obtained by the coil 20 and the controller 130, which is operatively connected to the detector interface 190, for storing the data relating to the surface conductivity of the coin 40, and resistance and inductance changes of the coil 20 when the coin passes it. Once these measurement data have been received for a coin, the logic device 732 will read the coin reference data stored in the memory 734, which also is operatively connected to the detector interface 190, and search for any matches. If the physical and magnetic properties for the iron coin measured by the coin discriminator 10 correspond to one specific iron coin type defined by the iron coin reference data, then the type of iron coin has been positively identified. Otherwise, the iron coin 40 is of an unknown type and handled by a coin reject device 740, which preferably will deliver the iron coin through an external opening in the machine 700, so that the iron coin may be removed by a user. The rejected iron coin 40 may also be re-circulated back into the coin discriminator 10 for another attempt to discriminate it.

The coin types defined by the coin reference data in the memory 734 may preferably relate to the denomination and currency of each different type of coin 40, which is to be handled by the coin processing machine 700.

Once the type or identity of the coin 40 has been determined by the coin discriminator 10 and the logic device 732, the coin is passed to a coin sorter 750, which uses the identified coin type to sort the coin 40 into one specific coin box, etc., in a coin storage 760. The coin boxes, etc., in the coin storage are preferably externally accessible for the user of the machine 700.

A future development of the coin discriminator 10 according to the invention would be to use more than one coil 20 if the coins 40 to be measured would have a larger diameter or thickness than the coins measured in this embodiment. In this case, the coils may have to be placed in different positions in relation to each other to be able to cover coins with different diameters, e.g. higher or lower in relation to the coin rail 90 and the other coil, in order to make accurate measurements of each coin 40.

What is claimed is:

1. A method of operating a coin discriminator by measuring how a metal coin affects a coil means when the coin is subjected to magnetic fields generated by the coil means external to the coin, and wherein eddy currents induced in the coin are detected by detection means external to the coin, the method comprising:

inducing a magnetic field in the coil means forming part of a resonant circuit of the coin discriminator by driving the coil means by time varying signals produced by an oscillator circuit, the oscillator circuit comprising a voltage controlled oscillator and a phase selector which feeds, in sequence, two phase-shifted outputs from the oscillator to drive the coil means, measuring eddy currents in the coin induced by the magnetic field of the coil means, wherein the eddy currents are measured at two frequencies that are determined by causing the oscillator circuit to lock, in sequence, with the two phase-shifted outputs from the oscillator, and comparing the determined frequencies with predetermined values of frequency for different types of coins for determining a type of the coin.

2. A method of operating a coin discriminator according to claim 1, characterized in that the two frequencies are measured at respective upper and lower 3 dB points.

3. A method of operating a coin discriminator according to claim 1, characterized in that the step of comparing the determined frequencies comprises the step of:

determining a shift in width of a resonant frequency curve of the coil and a shift of a resonant frequency of the coil means from the determined frequencies, and comparing the determined width of the resonant frequency with predetermined values for different types of coins for determining the type of the coin.

4. A method of operating a coin discriminator according to claim 3, characterized in that the step of comparing the determined width of the resonant frequency curve with predetermined values comprises the steps of:

converting the two frequencies into changes in inductance and resistance for the coil means, comparing the changes in inductance and resistance for the coil means with predetermined values for different types of coins.

5. A method of operating a coin discriminator according to claim 1, characterized in that:

the eddy currents are measured at an edge portion of the coin being positioned in the magnetic field generated by the coil means, wherein it is determined whether the measured edge portion of the coin is covered by a layer of another metal.

6. A method of operating a coin discriminator according to claim 1, characterized in that:

the eddy currents are induced in a surface of the center portion of the coin and are detected by measuring the eddy currents through the coil means.

7. A method of operating a coin discriminator according to claim 6, characterized by the steps of:

converting the measured eddy currents through the coil means into values of conductivity for the coin, comparing the values of conductivity for the coin with predetermined values for different types of coins, and determining the type of the measured coin by using the predetermined values.

8. A method of operating a coin discriminator according to claim 1, wherein the method drives the coil means with time varying drive signals having a frequency between 4 to 10 MHz, for surface conductivity measurement.

9. A method of operating a coin discriminator according to claim 1, wherein said metal coin is an iron corn.

10. A method of operating a coin discriminator according to claim 1, wherein said metal coin has a metal core covered by a layer of another metal, preferably copper, brass, or bronze.

11. A coin discriminator configured to measure how a metal coin affects a coil means of the discriminator when the coin is subjected to magnetic fields generated by the coil means external to the coin, and wherein eddy currents induced in the coin are detected by detection means of the discriminator external to the coin, the coin discriminator comprising:

an oscillator circuit for inducing a magnetic field in the coil means, the oscillator circuit comprising a voltage controlled oscillator having two phase-shifted outputs for driving the coil means, an eddy current detector for detecting and measuring frequencies of eddy currents induced by the magnetic field in the coin, the detector comprises a phase selector for feeding, in sequence, the two phase-shifted outputs from the oscillator to drive the coil means and to lock, in sequence, the oscillator circuit with the two phase-shifted outputs to measure the eddy currents at two determined frequencies, and means for comparing the frequencies of the measured eddy currents through the coil means with predetermined values of frequency for different types of coins for determining a type of the corn.

12. A coin discriminator according to claim 11, characterized in that said frequencies are measured at respective upper and lower 3 dB points.

13. A coin discriminator according to claim 11, characterized by:

a converter for converting the frequencies into changes in inductance and resistance for the coil-means, wherein said means for comparing is adapted to compare changes in inductance and resistance for the coil means with predetermined values for different types of coins.

14. A coin discriminator according to claim 11, characterized in that said eddy current detector detects the eddy currents at an edge portion of the coin.

15. A coin discriminator according to claim 14, characterized in that said discriminator is for determining if the edge portion of the coin is covered by a layer of another metal.

16. A coin discriminator according to claim 11, wherein said eddy current detector detects the eddy currents at a center portion of the coin.

17. A coin discriminator according to claim 16, characterized by:

a converter for converting parameters of the measured eddy currents through the coil means into values of surface conductivity for the coin, and means for comparing the values of surface conductivity for the coin with predetermined values for different types of coins.

18. A coin discriminator according to claim 11, wherein the discriminator drives the coil means with time varying drive signals having a frequency between 4 to 10 MHz.

19. A coin discriminator according to claim 11, wherein the eddy current detector measures two or more frequencies near the resonance, for determining a shift in width of a resonant frequency curve of the coil means and the shift of a resonant frequency of the coil means.

20. A coin discriminator according to claim 19, wherein said means for comparing compares the determined width of the resonant frequency curve of the coil means with predetermined values for different types of coins.

21. A coin discriminator according to claim 11, wherein said metal coin is an iron coin.

22. A coin discriminator according to claim 11, wherein said coin has a metal core covered by a layer of another metal, said another metal is copper, brass, or bronze.

23. A coin processing machine comprising a coin inlet, a coin feeder, and a coin processor, characterized in that the coin processing machine comprises a coin discriminator according to claim 11.

24. A coin processing machine according to claim 23, wherein the coin discriminator is coupled to the coin processor and is adapted to determine a type, identity or denomination of respective coins received from the coin feeder, and is adapted to supply the determined type, identity or denomination to the coin processor, characterized in that the coin processing machine comprises:

the coin discriminator positioned to induce and detect eddy currents in a center portion and an edge portion, respectively, of the coin;

a storage device operatively connected to the coin discriminator for storing coin reference data; and a logic device operatively connected to the coin discriminator for determining an identity of the coin by comparing said coin reference data to data obtained from the detected eddy currents and related to an effect of the coin on magnetic properties of the coin discriminator and a surface conductivity of the coin.

* * * * *